US010366651B2

(12) United States Patent
Ha

(10) Patent No.: US 10,366,651 B2
(45) Date of Patent: Jul. 30, 2019

(54) ORGANIC LIGHT-EMITTING DISPLAY DEVICE AND DRIVING METHOD THEREOF

(71) Applicant: LG DISPLAY CO., LTD., Seoul (KR)

(72) Inventor: Won Kyu Ha, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 216 days.

(21) Appl. No.: 15/366,688

(22) Filed: Dec. 1, 2016

(65) Prior Publication Data

US 2017/0162112 A1 Jun. 8, 2017

(30) Foreign Application Priority Data

Dec. 2, 2015 (KR) ..... 10-2015-0171025

(51) Int. Cl.

| | |
|---|---|
| ***G09G 3/3225*** | (2016.01) |
| ***G09G 3/3266*** | (2016.01) |
| ***G09G 3/3275*** | (2016.01) |
| ***G09G 3/3233*** | (2016.01) |
| ***G09G 3/3291*** | (2016.01) |

(52) U.S. Cl.

CPC ..... *G09G 3/3225* (2013.01); *G09G 3/3233* (2013.01); *G09G 3/3266* (2013.01); *G09G 3/3275* (2013.01); *G09G 3/3291* (2013.01); *G09G 2300/0819* (2013.01); *G09G 2300/0842* (2013.01); *G09G 2310/0205* (2013.01); *G09G 2310/0281* (2013.01); *G09G 2310/08* (2013.01); *G09G 2320/0233* (2013.01); *G09G 2320/0295* (2013.01)

(58) Field of Classification Search

None

See application file for complete search history.

(56) References Cited

U.S. PATENT DOCUMENTS

| | | | | |
|---|---|---|---|---|
| 2011/0157132 | A1* | 6/2011 | Byun | G09G 3/3677 345/211 |
| 2013/0140537 | A1* | 6/2013 | Ha | H01L 27/3262 257/40 |
| 2014/0009456 | A1* | 1/2014 | Kim | G09G 3/3208 345/212 |
| 2015/0009108 | A1* | 1/2015 | Song | G09G 3/3225 345/80 |
| 2015/0097762 | A1* | 4/2015 | Kim | G09G 3/3225 345/76 |

(Continued)

FOREIGN PATENT DOCUMENTS

| | | |
|---|---|---|
| CN | 101449311 A | 6/2009 |
| CN | 102117593 A | 7/2011 |
| CN | 104637443 A | 5/2015 |

*Primary Examiner* — Kent W Chang

*Assistant Examiner* — Benjamin Morales

(74) *Attorney, Agent, or Firm* — Seed Intellectual Property Law Group LLP

(57) ABSTRACT

An organic light-emitting display device includes a display panel, a source driver, a scan driver, and a timing controller. A gate node of a second transistor of an (N−1)-th sub pixel and a gate node of a first transistor of an N-th sub pixel are connected in common such that the second transistor of the (N−1)-th sub pixel and the first transistor of the N-th sub pixel are simultaneously turned on by a scan signal supplied to the second transistor of the (N−1)-th sub pixel. Accordingly, it is possible to decrease a size of the scan driver and a bezel area.

20 Claims, 10 Drawing Sheets

(56) References Cited

U.S. PATENT DOCUMENTS

| | | | | |
|---|---|---|---|---|
| 2015/0123107 | A1* | 5/2015 | Choi | H01L 27/3272 257/40 |
| 2015/0130785 | A1* | 5/2015 | Shin | G09G 3/3233 345/213 |
| 2015/0161943 | A1* | 6/2015 | Shim | G09G 3/3225 345/76 |
| 2016/0098960 | A1* | 4/2016 | Park | G09G 3/3233 345/205 |
| 2016/0189628 | A1* | 6/2016 | Choi | G09G 3/3233 345/690 |
| 2016/0189629 | A1* | 6/2016 | Jin | G09G 3/3233 345/211 |

* cited by examiner

ORGANIC LIGHT-EMITTING DISPLAY DEVICE AND DRIVING METHOD THEREOF

CROSS-REFERENCE TO RELATED APPLICATION

This application claims priority from Korean Patent Application No. 10-2015-0171025, filed Dec. 2, 2015, which is hereby incorporated by reference for all purposes as if fully set forth herein.

BACKGROUND

Technical Field

The present disclosure relates to an organic light-emitting display device and a driving method thereof.

Description of the Related Art

Organic light-emitting display devices having recently attracted attention as display devices employ organic light-emitting diodes (OLED) that emit light by themselves and, thus, have great advantages such as high response speed, high emission efficiency, high luminance, and a large viewing angle.

In such organic light-emitting display devices, sub pixels including an organic light-emitting diode are arranged in a matrix and brightness of the sub pixels selected by a scan signal is controlled on the basis of gray scales of data.

In such organic light-emitting display devices, circuit elements such as an organic light-emitting diode and a driving transistor in each sub pixel have specific characteristics (such as a threshold voltage or mobility).

The circuit elements in each sub pixel degrade with extension of a driving time and, thus, the characteristics thereof may vary. The luminance characteristic of the sub pixel can be changed with variation in the characteristics.

Therefore, techniques of sensing and compensating for the characteristics of the circuit elements in each sub pixel have been developed. A driving transistor, a switching transistor, a sensing transistor, and a storage capacitor are disposed in each sub pixel. This structure is also referred to as a "3T1C" structure.

Driving of the switch transistor and the sensing transistor in each sub pixel requires scan drivers that generate a scan signal and a sensing signal, thereby causing a problem with an increase in manufacturing cost.

A GIP (Gate In Panel) technique of directly mounting scan drivers for supplying a scan signal and a sensing signal on a display panel has been developed. This technique has a problem in that a bezel area (BA) increases when the number of scan drivers increases.

BRIEF SUMMARY

An object of the present disclosure is to provide an organic light-emitting display device that can decrease the size of a scan driver and a bezel area by simultaneously driving a first transistor and a second transistor disposed in neighboring sub pixels using a scan signal output from one scan driver and a driving method thereof.

Another object of the present disclosure is to provide an organic light-emitting display device that can drive a display while internally compensating for characteristic variations of sub pixels using one scan driver and a driving method thereof.

According to an aspect of the present disclosure, there is provided an organic light-emitting display device including: a display panel in which data lines are arranged in a first direction and gate lines are arranged in a second direction to define a plurality of sub pixels; a source driver configured to supply a data voltage to the data lines; a scan driver configured to supply scan signals to the gate lines; and a timing controller configured to control a driving timing of the source driver and a driving of the scan driver, wherein when an (N−1)-th sub pixel and an N-th sub pixel are named for neighboring sub pixels in a same column among the sub pixels (i.e., the (N−1)-th sub pixel and the N-th sub pixel are adjacent to one another in a same column), each (N−1)-th sub pixel and N-th sub pixel includes an organic light-emitting diode, a driving transistor configured to drive the organic light-emitting diode, a first transistor that is controlled by the sensing signal and connected between a reference voltage line for supplying a reference voltage and a first node of the driving transistor, a second transistor that is controlled by the scan signal and connected between the data line and a second node of the driving transistor, and a storage capacitor that is connected between the first node and the second node of the driving transistor, and a gate node of the second transistor of the (N−1)-th sub pixel and a gate node of the first transistor of the N-th sub pixel are connected in common such that the second transistor of the (N−1)-th sub pixel and the first transistor of the N-th sub pixel are simultaneously turned on by the scan signal supplied to the second transistor of the (N−1)-th sub pixel. Accordingly, it is possible to decrease a size of a scan driver and a bezel area.

According to another aspect of the present disclosure, there is provided a driving method of an organic light-emitting display device including a plurality of sub pixels of which each includes an organic light-emitting diode, a driving transistor configured to drive the organic light-emitting diode, a first transistor that is controlled by a sensing signal and connected between a reference voltage line for supplying a reference voltage and a first node of the driving transistor, a second transistor that is controlled by a scan signal and connected between a data line and a second node of the driving transistor, and a storage capacitor that is connected between the first node and the second node of the driving transistor, the driving method including: performing initialization and data programming on an N-th sub pixel in an overlap section of an N-th scan signal and an (N−1)-th scan signal; switching the scan signal supplied to an (N−1)-th sub pixel to a low level, causing the first node of the driving transistor of the N-th sub pixel to float, and compensating a threshold voltage of the driving transistor; maintaining a voltage between the second node and the first node of the driving transistor of the N-th sub pixel by the compensation for the threshold voltage; and switching the scan signal supplied to the second transistor of the N-th sub pixel to the low level and causing the organic light-emitting diode of the N-th sub pixel to emit light. Accordingly, it is possible to decrease a size of a scan driver and a bezel area.

In the organic light-emitting display device and the driving method thereof according to the various embodiments provided by the present disclosure, it is possible to decrease the size of a scan driver and a bezel area by simultaneously driving a first transistor and a second transistor disposed in neighboring sub pixels using a scan signal output from one scan driver and a driving method thereof.

In the organic light-emitting display device and the driving method thereof according the various embodiments provided by to the present disclosure, it is possible to drive a display while internally compensating for characteristics variations of sub pixels using one scan driver and a driving method thereof.

BRIEF DESCRIPTION OF THE DRAWINGS

The above and other objects, features and advantages of the present disclosure will be more apparent from the following detailed description taken in conjunction with the accompanying drawings, in which.

DETAILED DESCRIPTION

Figure 1:
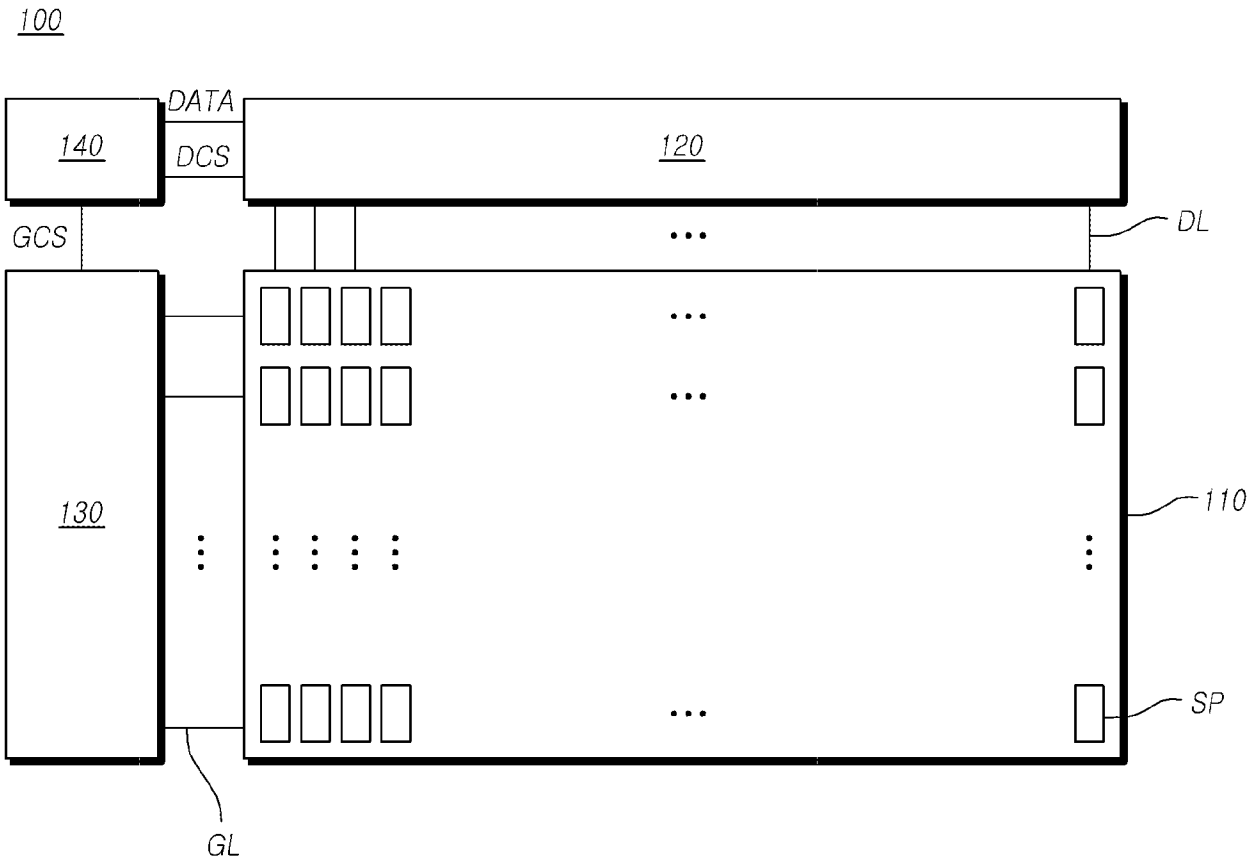
FIG. 1 is a diagram illustrating a schematic system configuration of an organic light-emitting display device according to an embodiment of the present disclosure.

Advantages and features of the disclosure and methods for achieving the advantages or features will be apparent from embodiments described below in detail with reference to the accompanying drawings. However, the disclosure is not limited to these embodiments but can be modified in various forms. The embodiments are merely for completing disclosure of the invention and are provided to completely inform those skilled in the art of the scope of the invention. The scope of the invention is defined by only the appended claims.

Shapes, sizes, ratios, angles, number of pieces, and the like illustrated in the drawings for the purpose of explaining the embodiments of the disclosure are exemplary and, thus, the disclosure is not limited to the illustrated items. Like reference numerals in the entire specification denote like elements. When it is determined that detailed description of known techniques involved in the disclosure makes the gist of the disclosure obscure, then such detailed description thereof will not be made.

When "include," "have," "be constituted," and the like are mentioned in the specification, another element may be added unless "only" is specifically used to exclude such meaning. A singular expression of an element includes two or more elements unless differently mentioned.

In analyzing elements, an error range is included even when explicit description is not made.

For example, when a positional relationship of two elements is described using "on," "above," "below," "beside," and the like, one or more other elements may be located therebetween unless "immediately" or "directly" is used.

For example, when temporal relationships are described using "after", "subsequent to", "next", "before", and the like, such expressions may include temporal discontinuity unless "immediately" or "directly" is used to exclude such meaning.

Terms "first," "second," and the like can be used to describe various elements, but the elements should not be limited to the terms. The terms are used only to distinguish an element from another. Therefore, a first element may be a second element within the technical spirit of the disclosure.

Features of embodiments of the disclosure can be coupled or combined partially or on the whole and can be technically interlinked and driven in various forms. The embodiments may be put into practice independently or in various combinations.

Hereinafter, embodiments of the present disclosure will be described in detail with reference to the accompanying drawings. In the drawings, sizes, thicknesses, and the like of elements may be exaggerated for convenience of explanation. The same reference numerals over the entire specification denote the same elements.

FIG. 1 is a diagram illustrating a schematic system structure of an organic light-emitting display device according to an embodiment of the present disclosure.

Referring to FIG. 1, an organic light-emitting display device 100 according to the embodiment of the present disclosure includes a display panel 110 in which plural data lines DL and plural gate lines GL are arranged and plural sub pixels SP are arranged. The organic light-emitting display device 100 further includes a source driver 120 that drives the data lines DL, a scan driver 130 that drives the gate lines GL, and a timing controller 140 that controls the source driver 120 and the scan driver 130.

The timing controller 140 supplies various control signals to the source driver 120 and the scan driver 130 to control the source driver 120 and the scan driver 130.

The timing controller 140 starts scanning at a timing of each frame, switches externally input image data to a data signal format which is used by the source driver 120, outputs the switched image data, and controls display driving data at an appropriate timing corresponding to a scan signal.

The source driver 120 drives the plural data lines DL by supplying a driving data voltage Vdata to the data lines DL. Here, the source driver 120 is also referred to as a "data driver."

The scan driver 130 sequentially drives the plural gate lines GL by sequentially supplying a scan signal to the gate lines GL. Here, the scan driver 130 is also referred to as a "gate driver."

The scan driver 130 sequentially supplies a scan signal of an ON voltage or an OFF voltage to the gate lines GL under the control of the timing controller 140.

When a specific gate line is selected by the scan driver 130, the source driver 120 converts image data received from the timing controller 140 into an analog data voltage and supplies the analog data voltage to the data lines DL.

The source driver 120 may be located on only one side (for example, an upper side or a lower side) of the display panel 110 in FIG. 1, or may be located on both sides (for example, the upper side and the lower side) of the display panel 110 depending on a driving method, a panel design method, or the like.

The scan driver 130 may be located on only one side (for example, a right side or a left side) of the display panel 110 in FIG. 1, or may be located on both sides (for example, the right side and the left side) of the display panel 110 depending on a driving method, a panel design method, or the like.

The timing controller 140 receives various timing signals including a vertical synchronization signal Vsync, a horizontal synchronization signal Hsync, an input data enable (DE) signal, and a clock signal CLK along with input image data from the outside (for example, from a host system).

As well as switching the externally input image data to the data signal format which is used by the source driver 120 and outputting the switched image data, the timing controller 140 receives the timing signals such as a vertical synchronization signal Vsync, a horizontal synchronization signal Hsync, an input DE signal, and a clock signal and generates and outputs various control signals to the source driver 120 and the scan driver 130 in order to control the source driver 120 and the scan driver 130.

For example, the timing controller 140 outputs various gate control signals (GCS) including a gate start pulse (GSP), a gate shift clock (GSC), and a gate output enable (GOE) signal to control the scan driver 130.

Here, the gate start pulse (GSP) controls an operation start timing of one or more gate driver ICs of the scan driver 130. The gate shift clock (GSC) is a clock signal which is input commonly to the one or more gate driver ICs and controls a shift timing of a scan signal (a gate pulse). The gate output enable (GOE) signal designates timing information of the one or more gate driver ICs.

The timing controller 140 outputs various data control signals (DCS) including a source start pulse (SSP), a source sampling clock (SSC), and a source output enable (SOE) signal to control the source driver 120.

Here, the source start pulse (SSP) controls a data sampling start timing of one or more source driver ICs of the source driver 120. The source sampling clock (SSC) is a clock signal for controlling a data sampling timing of each source driver IC. The source output enable (SOE) signal controls the output timing of the source driver 120.

The source driver 120 includes at least one source driver IC (SDIC) and can drive plural data lines.

Each source driver IC (SDIC) may include a shift register, a latch circuit, a digital-to-analog converter (DAC), an output buffer, and a gamma voltage generator.

The scan driver 130 may include at least one gate driver IC (GDIC).

Each gate driver IC (GDIC) may include a shift register and a level shifter.

Each sub pixel SP disposed in the display panel 110 includes circuit elements such as a transistor.

For example, each sub pixel SP of the display panel 110 includes an organic light-emitting diode OLED and circuit elements, such as a driving transistor, for driving the organic light-emitting diode OLED.

The types and numbers of circuit elements constituting each sub pixel SP may be different in various embodiments, depending on provided functions, design methods, and the like.

Figure 2:
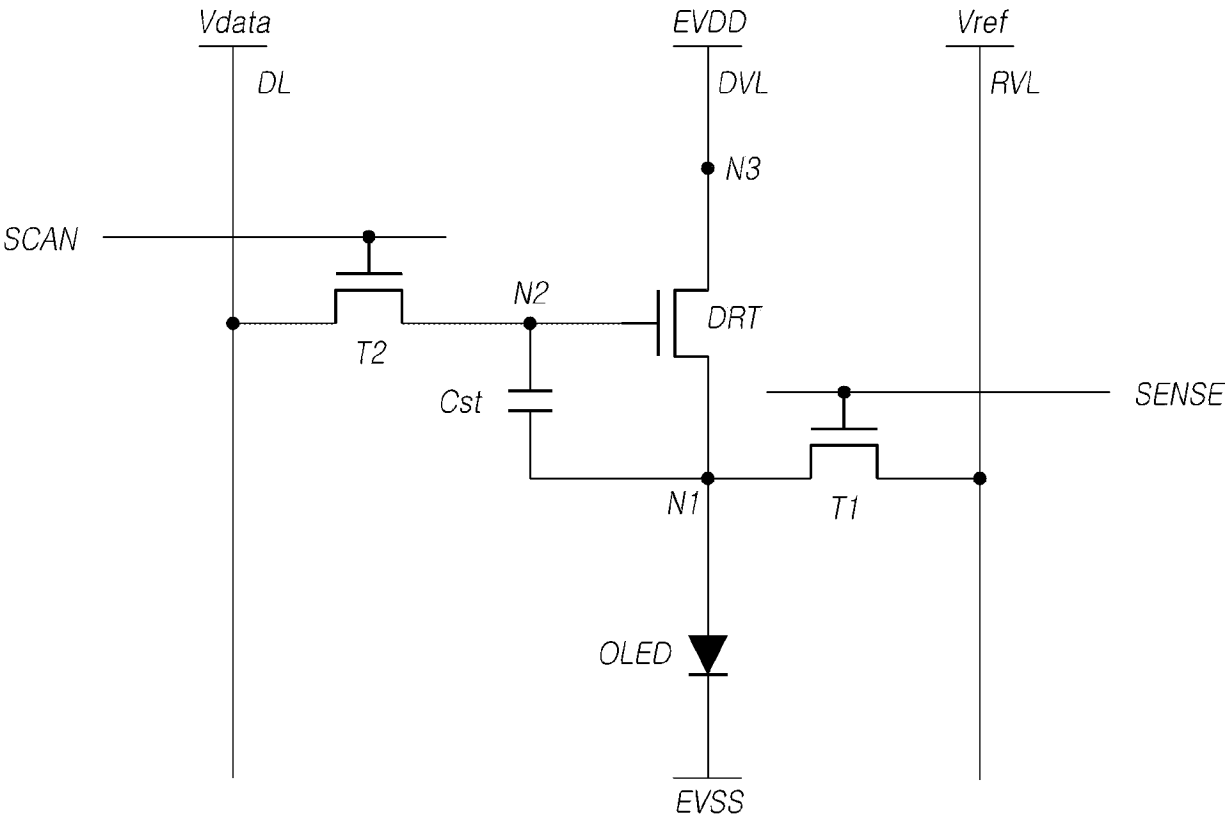
FIG. 2 is a diagram illustrating a sub pixel structure of the organic light-emitting display device according to an embodiment of the present disclosure.

FIG. 2 is a diagram illustrating a sub pixel structure of the organic light-emitting display device according to one or more embodiments of the present disclosure.

Referring to FIG. 2, in the organic light-emitting display device 100 according to embodiments of the present disclosure, each sub pixel includes an organic light-emitting diode OLED, a driving transistor DRT for driving the organic light-emitting diode OLED, a first transistor T1 that is electrically connected between a first node N1 of the driving transistor DRT and a reference voltage line RVL for supplying a reference voltage Vref, a second transistor T2 that is electrically connected between a second node N2 of the driving transistor DRT and a data line DL for supplying a data voltage Vdata, and a storage capacitor Cst that is electrically connected between the first node N1 and the second node N2 of the driving transistor DRT. The reference voltage line RVL is also referred to as a sensing line SL.

The organic light-emitting diode OLED includes a first electrode (for example, an anode or a cathode), an organic layer, and a second electrode (for example, the cathode or the anode).

The driving transistor DRT drives the organic light-emitting diode OLED by supplying a driving current to the organic light-emitting diode OLED.

The first node N1 of the driving transistor DRT can be electrically connected to the first electrode of the organic light-emitting diode OLED and may be a source node or a drain node.

The second node N2 of the driving transistor DRT can be electrically connected to a source node or a drain node of the second transistor T2 and may be a gate node for the driving transistor DRT. A third node N3 of the driving transistor DRT can be electrically connected to a driving voltage line (DVL) for supplying a driving voltage EVDD and may be a drain node or a source node.

As illustrated in FIG. 2, the first transistor T1 is turned on by a sensing signal SENSE and applies the reference voltage Vref to the first node N1 of the driving transistor DRT.

The first transistor T1 may be used as a voltage sensing path for the first node N1 of the driving transistor DRT when the first transistor is turned on. Accordingly, the first transistor T1 is also referred to as a "sensing transistor."

The second transistor T2 is turned on by a scan signal SCAN and transmits the data voltage Vdata supplied via the data line DL to the second node N2 of the driving transistor DRT. Accordingly, the second transistor T2 is also referred to as a "switching transistor."

The storage capacitor Cst is electrically connected between the first node N1 and the second node N2 of the driving transistor DRT and functions to hold a data voltage corresponding to the image signal voltage or a voltage corresponding thereto for one frame.

The storage capacitor Cst is not a parasitic capacitor (for example, Cgs or Cgd) which is an internal capacitor present between the first node N1 and the second node N2 of the driving transistor DRT, but instead is an external capacitor which is intentionally designed outside the driving transistor DRT.

Figure 3A:
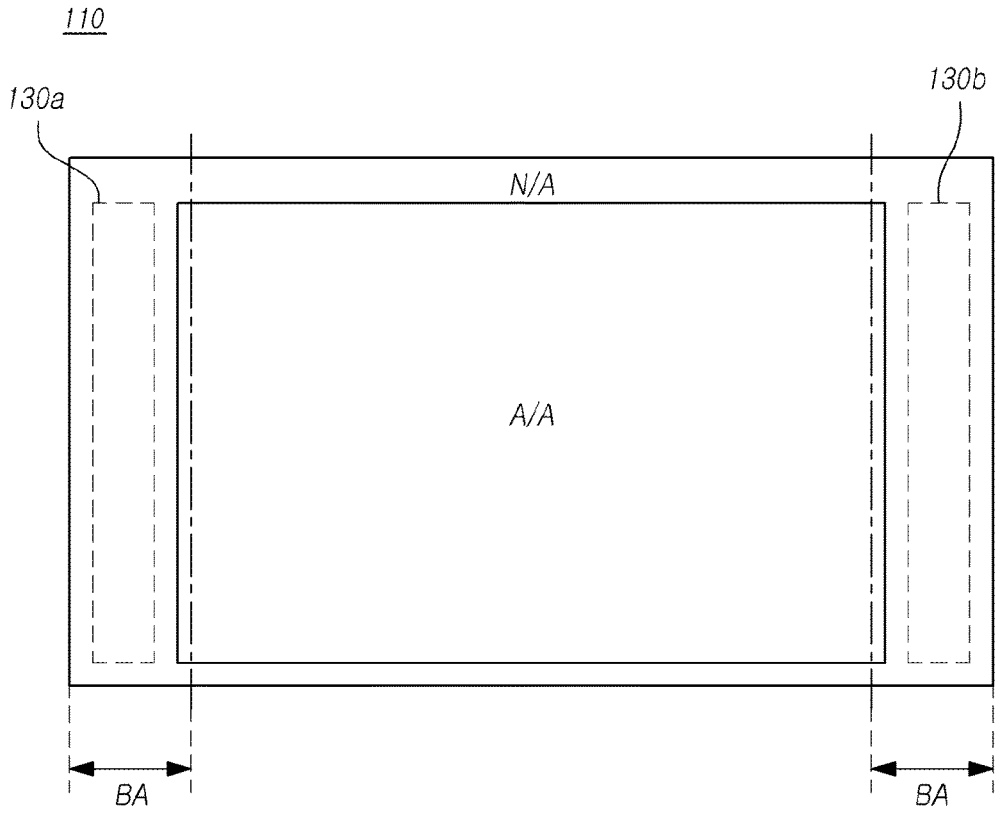
FIGS. 3A and 3B are diagrams illustrating an example in which a bezel area increases when a scan driver is mounted on a display panel in a GIP type.
Figure 3B:
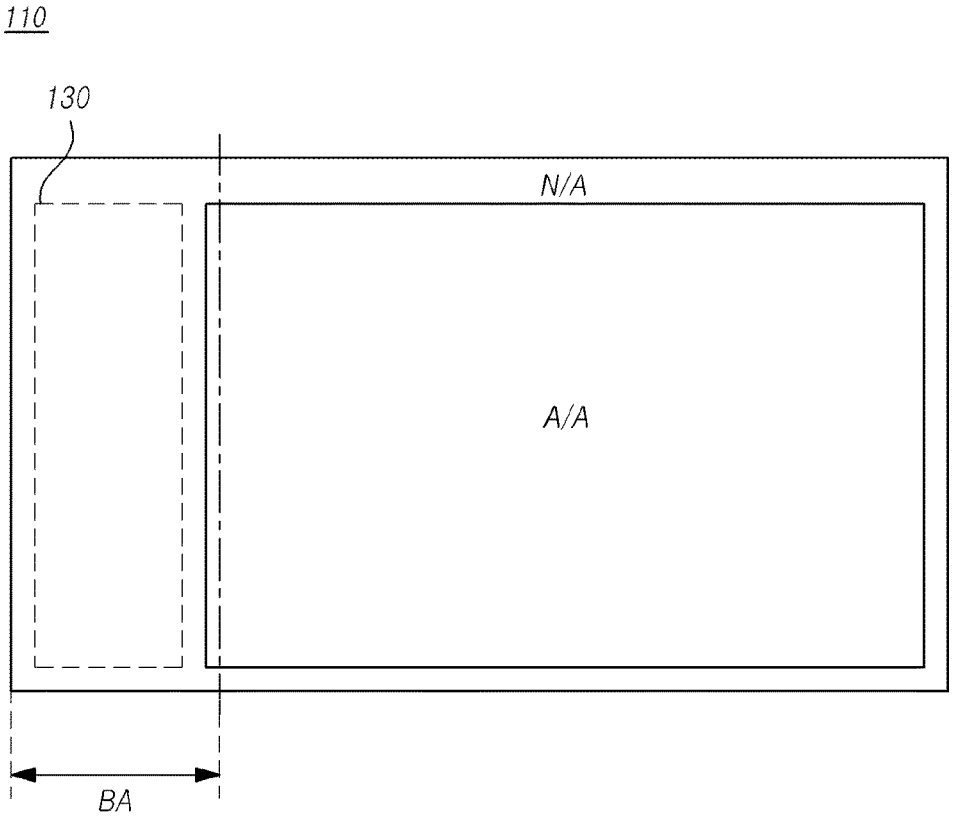

FIGS. 3A and 3B are diagrams illustrating an example in which a bezel area increases when the scan driver is mounted on the display panel in a gate in panel (GIP) type.

Referring to FIG. 3A, the scan driver 130 can be embodied by a first scan driver 130*a* for supplying the scan signal SCAN in FIG. 2 and a second scan driver 130*b* for supplying the sensing signal SENSE.

When a scan driver is mounted on the display panel 110 in the GIP type, a non-display area N/A (a non-active area) is disposed around a display area A/A (an active area) of the display panel 110.

When the first and second scan drivers 130*a* and 130*b* are disposed to drive the first transistor T1 and the second transistor T2 which are disposed in each sub pixel, the non-display area N/A increases and the bezel area BA corresponding thereto also increases.

As described above, when the bezel area BA of the organic light-emitting display device 100 increases, there is a problem in that the display area A/A for displaying an image decreases.

In FIG. 3B, a single scan driver 130 includes a driving circuit (such as a shift register) for generating the scan signal SCAN and a driving circuit for generating the sensing signal SENSE and thus the size of the scan driver 130 increases.

Accordingly, the number of scan drivers 130 is one, but the size of the scan driver 130 increases, thereby causing a problem in that the bezel area BA increases.

In addition, since two different scan drivers should be disposed or different driving circuits (e.g., the scan signal generation circuit and the sensing signal generation circuit) should be disposed in a single scan driver, there is a problem in that the manufacturing cost increases.

In an organic light-emitting display device and a driving method thereof according to embodiments of the present disclosure, it is possible to decrease the size of the scan driver and the bezel area by simultaneously driving the first transistor T1 and the second transistor T2 which are disposed in neighboring sub pixels using a scan signal output from a single scan driver.

In the organic light-emitting display device and the driving method thereof according to embodiments of the present disclosure, it is possible to drive a display while internally compensating for characteristic variations of sub pixels using a single scan driver.

Figure 4:
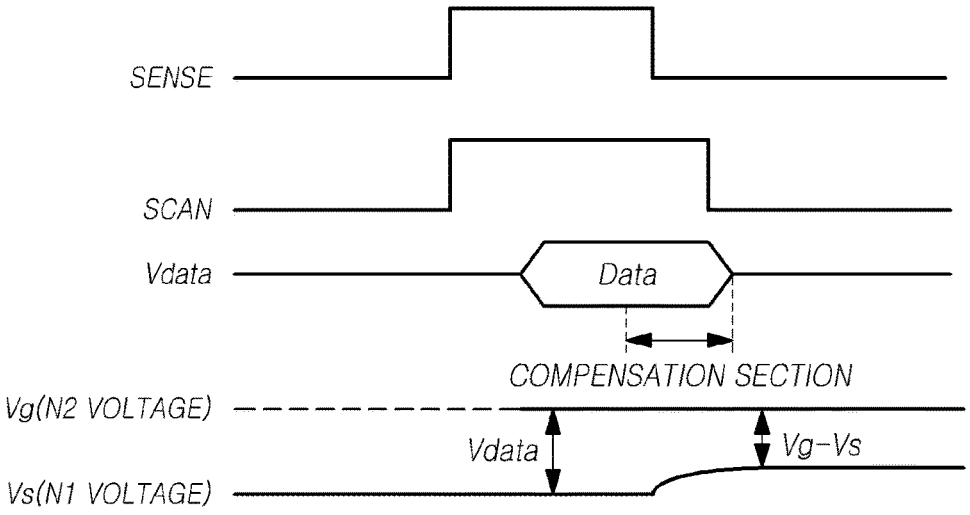
FIG. 4 is a signal diagram illustrating internal compensation for a sub pixel (e.g., the subpixel shown in FIG. 2) of the organic light-emitting display device according to an embodiment of the present disclosure.

FIG. 4 is a diagram illustrating internal compensation for a sub pixel of the organic light-emitting display device shown in FIG. 2, according to one or more embodiments of the present disclosure.

Referring to FIGS. 2 and 4, in the organic light-emitting display device 100 according to embodiments of the present disclosure, each sub pixel includes the organic light-emitting diode OLED, the driving transistor DRT, the first transistor T1, the second transistor T2, and the storage capacitor Cst as illustrated in FIG. 2.

The internal compensation of the organic light-emitting display device 100 according to embodiments of the present disclosure can be performed in real time. Here, the internal compensation includes threshold voltage Vth compensation and mobility compensation of the driving transistor DRT which is disposed in a sub pixel.

First, when the organic light-emitting display device 100 according to embodiments of the present disclosure is driven, a scan signal SCAN is supplied at a high level and a data voltage Vdata is supplied at an initialization level in an initialization and data programming step. At this time, the first transistor T1 is supplied with a sensing signal of a high level and is supplied with a reference voltage Vref via the reference voltage line RVL.

In this way, since the scan signal SCAN and the sensing signal SENSE are supplied at a high level, the second transistor T2 (the switching transistor) and the first transistor T1 (the sensing transistor) are turned on and the data voltage of the initialization level is applied to the second node N2 of the driving transistor DRT via the second transistor T2.

The reference voltage Vref is applied to the first node N1 of the driving transistor DRT via the first transistor T1.

Accordingly, the first node N1 and the second node N2 of the driving transistor DRT are initialized with the reference voltage Vref and the data voltage Vdata of the initialization level, respectively. The reference voltage Vref and the data voltage Vdata of the initialization level may be different from each other.

After the initialization and data programming step, an internal compensation step is performed. At this time, the sensing signal SENSE is supplied at a low level, and the first transistor T1 is thus turned off. Accordingly, since the reference voltage is not supplied from the reference voltage line RVL, the first node N1 of the driving transistor DRT is in a floating state.

Accordingly, the voltage of the first node N1 of the driving transistor DRT increases due to a source following phenomenon.

Accordingly, the voltage of the second node N2 of the driving transistor DRT increases from the data voltage of the initialization level and the voltage of the first node N1 of the driving transistor DRT in the floating state increases due to the source following phenomenon.

The voltage increase ΔV of the first node N1 of the driving transistor DRT increases in proportion to the mobility of the driving transistor DRT. That is, since the voltage increase of the source node Vs of the driving transistor DRT varies depending on a threshold voltage Vth difference or a mobility difference due to degradation of the driving transistor DRT, the internal compensation is performed using the voltage increase of the source node Vs of the driving transistor DRT (compensation for a characteristic value of a sub pixel).

Accordingly, the Vgs voltage between the gate node (the second node N2) and the source node (the first node N1) of the driving transistor DRT is set depending on a degree of degradation of the driving transistor DRT, and the scan signal SCAN is changed to the low level before the voltage of the first node N1 of the driving transistor DRT is saturated on the basis thereof, whereby the organic light-emitting diode OLED emits light (a light-emitting step).

Particularly, in the organic light-emitting display device and the driving method thereof according to embodiments of the present disclosure, it is possible to drive the display while performing internal compensation (for the threshold voltage Vth) for the degradation of the driving transistor DRT by supplying the scan signal output from a single scan driver 130 to the switch transistor T2 and the sensing transistor T1 of the neighboring sub pixels in the column direction.

That is, by causing the second transistor T2 (the switching transistor) of the (N−1)-th sub pixel and the first transistor T1 (the sensing transistor) of the N-th sub pixel which correspond to the (N−1)-th gate line GL among the sub pixels to operate using the scan signal supplied to the (N−1)-th sub pixel, the internal compensation for characteristic variations of the sub pixels and the display driving can be performed without using an additional driver for generating another sensing signal.

Accordingly, in the organic light-emitting display device and the driving method thereof according to embodiments of the present disclosure, only one scan driver can be disposed in the display panel and there is an advantage in that the bezel area BA corresponding to the non-display area N/A (the non-active area) can be decreased.

Figure 5:
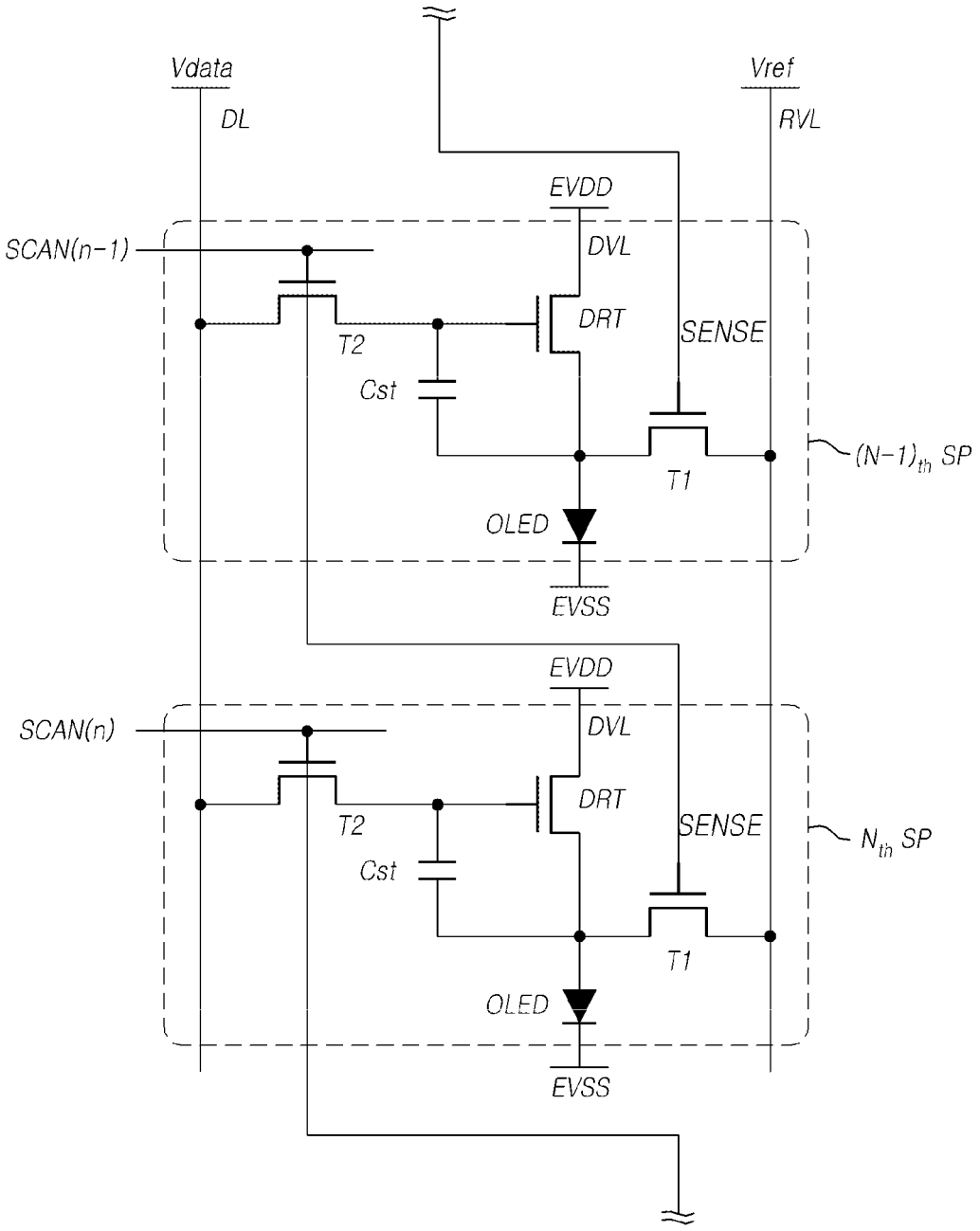
FIG. 5 is a diagram illustrating a connection structure of sub pixels of the organic light-emitting display device according to an embodiment of the present disclosure.
Figure 6:
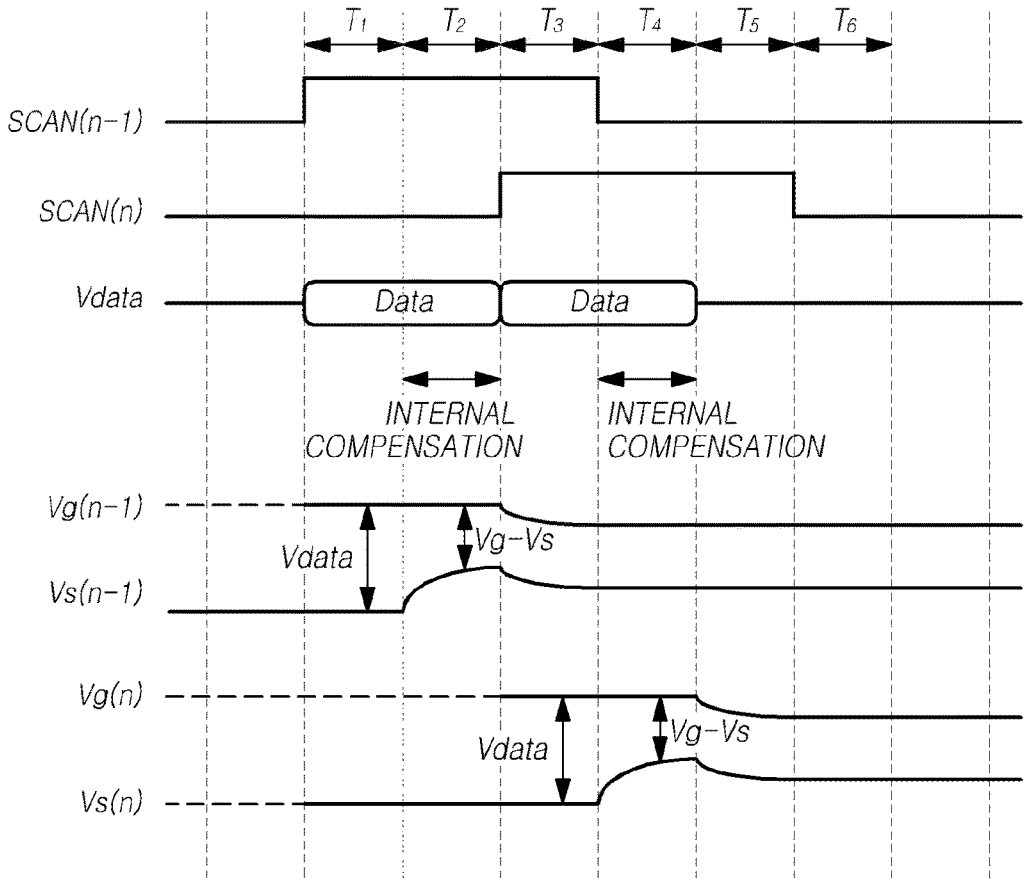
FIG. 6 is a diagram illustrating a driving method of neighboring sub pixels of the organic light-emitting display device according to an embodiment of the present disclosure.

FIG. 5 is a diagram illustrating a connection structure of sub pixels of the organic light-emitting display device according to embodiments of the present disclosure, and FIG. 6 is a diagram illustrating the driving method of neighboring sub pixels of the organic light-emitting display device according to the present disclosure.

Referring to FIGS. 5 and 6, the organic light-emitting display device 100 according to embodiments of the present disclosure includes the display panel 110 in which plural sub pixels are defined by the data lines arranged in a first direction and the gate lines arranged in a second direction, the source driver 120, the scan driver 130, and the timing controller 140 are as illustrated in FIG. 1.

Among the sub pixels arranged in the display area of the display panel 110, an (N−1)-th sub pixel (N−1)-th SP and an N-th sub pixel N-th SP in the same column direction, that is, in a direction in which the gate lines GL are sequentially arranged, are defined as neighboring sub pixels. That is, the (N−1)-th sub pixel and the N-th sub pixel are adjacent to one another in a column direction.

Accordingly, the N-th sub pixel N-th SP is located in the row corresponding to the N-th gate line GLn and the (N−1)-th sub pixel (N−1)-th SP is located in the row corresponding to the (N−1)-th gate line GL.

As illustrated in FIG. 5, the gate node of the second transistor T2 of the (N−1)-th sub pixel SP is commonly connected to the gate node of the first transistor T1 of the N-th sub pixel SP. That is, the (N−1)-th gate line GL(n−1) corresponding to the (N−1)-th sub pixel SP is connected to the gate node of the first transistor T1 of the N-th sub pixel SP.

The reference voltage line RVL is commonly connected to the first transistors T1 of the (N−1)-th sub pixel SP and the N-th sub pixel SP, and the second transistor T2 of the (N−1)-th sub pixel SP and the second transistor T2 of the N-th sub pixel SP are commonly connected to the same data line DL.

Accordingly, in one or more embodiments of the present disclosure, the (N−1)-th scan signal SCAN(n−1) of the scan signals output from the scan driver 130 can simultaneously turn on the second transistor T2 of the (N−1)-th sub pixel and the first transistor T1 of the N-th sub pixel via the (N−1)-th gate line GL(n−1).

As illustrated in FIG. 6, the (N−1)-th scan signal SCAN (n−1) supplied to the (N−1)-th sub pixel maintains the high level for 3/2 of a horizontal period H, and the N-th scan signal SCAN(n) supplied to the N-th sub pixel also maintains the high level for 3/2 of a horizontal period H. One horizontal period H is equal to the period for which the data voltage Vdata is applied, which is shown in FIG. 6 as being 2T. For example, the period $T_1$ through $T_2$ corresponds to a first horizontal period H in which a first data is supplied by the data voltage Vdata. The scan signal SCAN(n−1) has a high level from the beginning of period $T_1$ until the end of period $T_3$, and thus maintains the high level for 3/2 of the horizontal period H. Similarly, the scan signal SCAN(n) maintains a high level from period $T_3$ through period $T_5$, which is 3/2 of a second horizontal period H (i.e., the period $T_3$ through $T_4$, in which the second data is supplied by the data voltage Vdata).

The high-level section of the (N−1)-th scan signal SCAN (n−1) and the N-th scan signal SCAN(n) are shown being distributed across a plurality of sections ($T_1$ to $T_5$), each of which have a period that is ½ of a horizontal period H. Here, the (N−1)-th scan signal SCAN(n−1) and the N-th scan signal SCAN(n) overlap each other in the third section $T_3$ (i.e., both of the scan signals SCAN(n−1) and SCAN(n) have a high value during the section $T_3$.

For example, with a focus on the (N−1)-th sub pixel SP, the initialization and data programming step described with reference to FIG. 4 is performed in the first section T1 in which the data voltage Vdata is supplied. Here, the data voltage Vdata is supplied to the sub pixels SP for every horizontal period H.

The (N−1)-th scan signal SCAN(n−1) is a driving signal of the second transistor T2 of the (N−1)-th sub pixel, and further functions as a sensing signal of the first transistor T1 of the N-th sub pixel SP.

Then, in the second section $T_2$, the threshold voltage Vth compensation or the mobility compensation is performed as the internal compensation. The threshold voltage Vth compensation is performed with an increase in the voltage Vs of the source node (i.e., the first node N1, as shown in FIG. 2) of the driving transistor DRT of the (N−1)-th sub pixel SP.

Then, in the third section $T_3$, the N-th sub pixel SP is supplied with the N-th scan signal SCAN(n) and the data voltage Vdata. Accordingly, the data voltage Vdata supplied to the N-th sub pixel SP is also supplied to the (N−1)-th sub pixel SP and the gate node voltage Vg of the driving transistor DRT of the (N−1)-th sub pixel SP fluctuates.

At this time, the source node voltage Vs of the driving transistor DRT of the (N−1)-th sub pixel also fluctuates due to a coupling phenomenon of the gate node and the source node of the (N−1)-th sub pixel SP and thus the voltage Vgs is held. That is, in one or more embodiments of the present disclosure, after the internal compensation process is performed on the sub pixels, the voltage Vgs is held in the subsequent ½ horizontal period (here, the sections $T_3$ and $T_5$).

Then, in the fourth section $T_4$ in which the (N−1)-th scan signal SCAN(n−1) is at the low level, the organic light-emitting diode OLED of the (N−1)-th sub pixel SP emits light.

In the same way, in the N-th sub pixel, the initialization and data programming step is performed in the third section $T_3$, the internal compensation step is performed in the fourth step $T_4$, the Vgs maintaining step is performed in the fifth section $T_5$, and the light-emitting step is performed in the sixth section $T_6$.

In this way, in the organic light-emitting display device and the driving method thereof according to embodiments of the present disclosure, it is possible to decrease the size of the scan driver and the bezel area by simultaneously driving the first transistor T1 and the second transistor T2 disposed in neighboring sub pixels using the scan signal output from one scan driver (i.e., without needing an additional scan driver for supplying the sensing signal SENSE).

In the organic light-emitting display device and the driving method thereof according to embodiments of the present disclosure, it is possible to drive a display while internally compensating for characteristics variations of the sub pixels using one scan driver.

Figure 7:
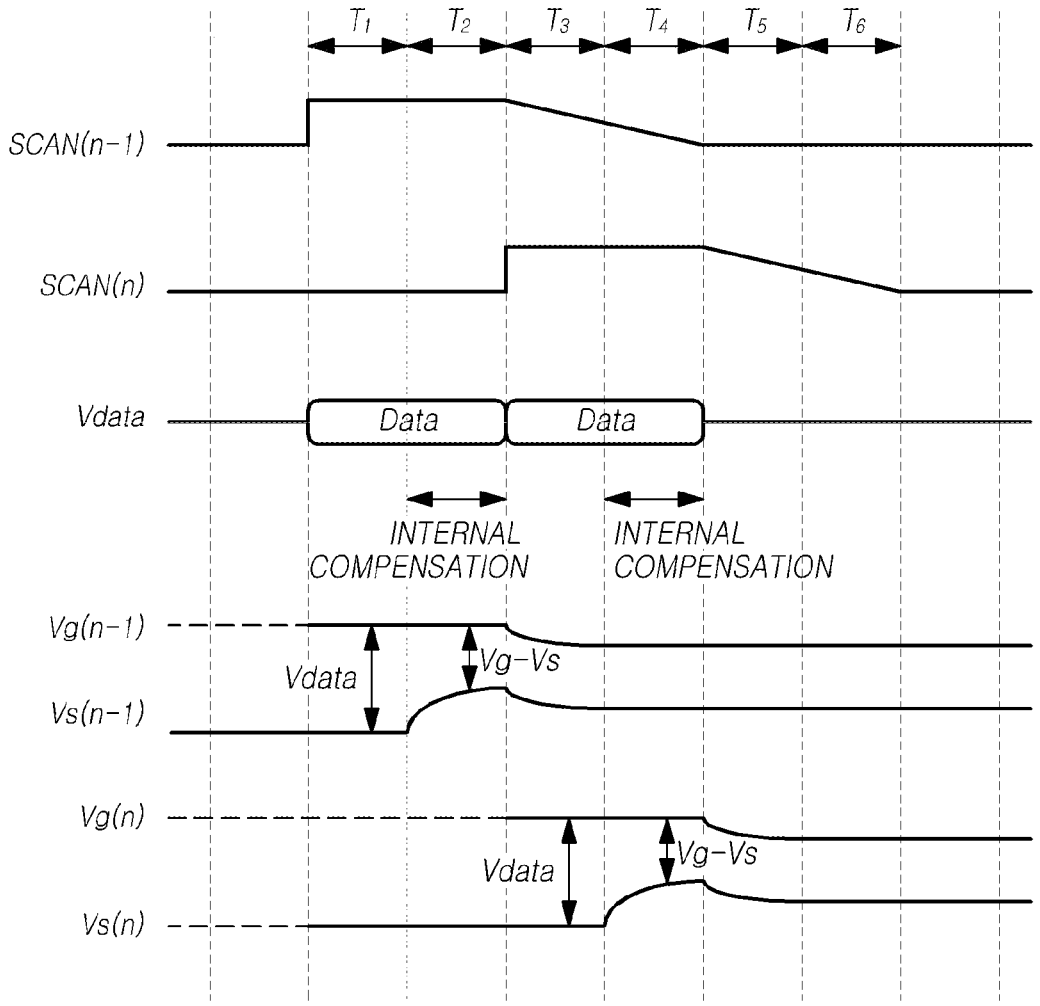
FIG. 7 is a diagram illustrating a driving method of neighboring sub pixels of an organic light-emitting display device according to another embodiment of the present disclosure.

FIG. 7 is a diagram illustrating a driving method of neighboring sub pixels of an organic light-emitting display device according to another embodiment of the present disclosure.

Referring to FIG. 7, similarly to the driving method described above with reference to FIGS. 5 and 6, the scan signal SCAN(n−1) supplied to the (N−1)-th sub pixel and the scan signal SCAN(n) supplied to the N-th sub pixel are supplied at the high level of two horizontal periods H with a waveform having a predetermined inclination during one horizontal period H.

That is, the (N−1)-th scan signal SCAN(n−1) has a constant high level in the first and second sections $T_1$ and $T_2$, and has an inclined level which is higher than the low level and linearly decreases from the high level to the low level in the third and fourth sections $T_3$ and $T_4$.

Similarly, the N-th scan signal SCAN(n) has a constant high level in the third and fourth sections $T_3$ and $T_4$, and has an inclined level which is higher than the low level and linearly decreases from the high level to the low level in the fifth and sixth sections $T_5$ and $T_6$.

The initialization and data programming step, the internal compensation step, the Vgs maintaining step, and the light-emitting step in the (N−1)-th sub pixel SP and the N-th sub pixel SP are the same as described above with reference to FIGS. 5 and 6 and, thus, description thereof will not be repeated.

In this way, in the organic light-emitting display device and the driving method thereof according to embodiments of the present disclosure, it is possible to decrease the size of the scan driver and the bezel area by simultaneously driving the first transistor T1 and the second transistor T2 disposed in neighboring sub pixels using the scan signal output from one scan driver.

In the organic light-emitting display device and the driving method thereof according to embodiments of the present disclosure, it is possible to drive a display while internally compensating for characteristics variations of sub pixels using one scan driver.

Figure 8:
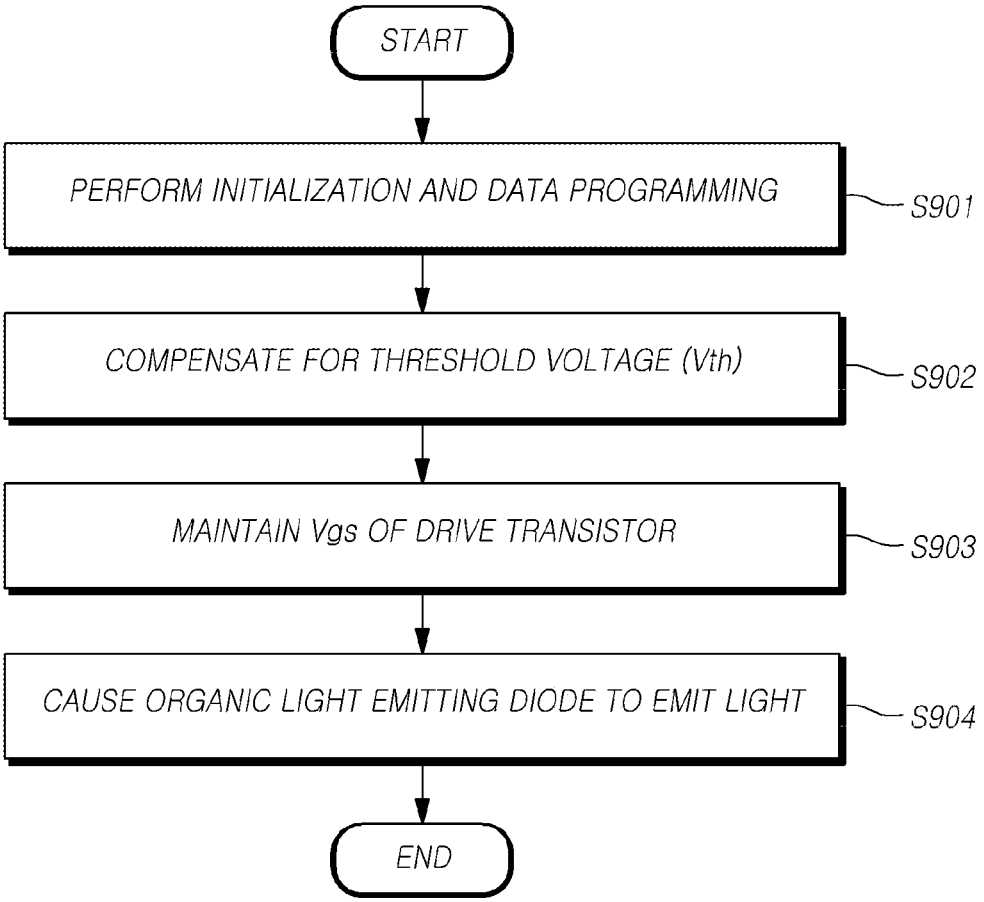
FIG. 8 is a flowchart illustrating a driving method of the organic light-emitting display device according to an embodiment of the present disclosure.

FIG. 8 is a flowchart illustrating a driving method of the organic light-emitting display device according to the present disclosure.

Referring to FIG. 8, in the driving method of the organic light-emitting display device according to embodiments of the present disclosure, when the (N−1)-th scan signal SCAN (n−1) is supplied to the (N−1)-th sub pixel SP and the N-th sub pixel SP which are adjacent in the column direction of the sub pixels, the initialization and data programming step is performed in the (N−1)-th sub pixel SP, as shown at S901.

Then, the (N−2)-th scan signal SCAN(n−2) is changed to the low level and the voltage Vs of the source node (the first node in FIG. 2) of the driving transistor DRT of the (N−1)-th sub pixel SP increases to perform the threshold voltage Vth compensation (S902).

Then, the step (S903) of maintaining the source node voltage Vs constant by the coupling phenomenon of the gate node and the source node of the (N−1)-th sub pixel SP is performed. Thereafter, the (N−1)-th scan signal SCAN(n−1) is changed to the low level and the organic light-emitting diode OLED of the (N−1)-th sub pixel SP emits light (S904).

In the same way, in the N-th sub pixel, the initialization and data programming step, the internal compensation step, the Vgs maintaining step, and the light-emitting step of the organic light-emitting diode are performed with the (N−1)-th scan signal SCAN(n−1).

Figure 9:
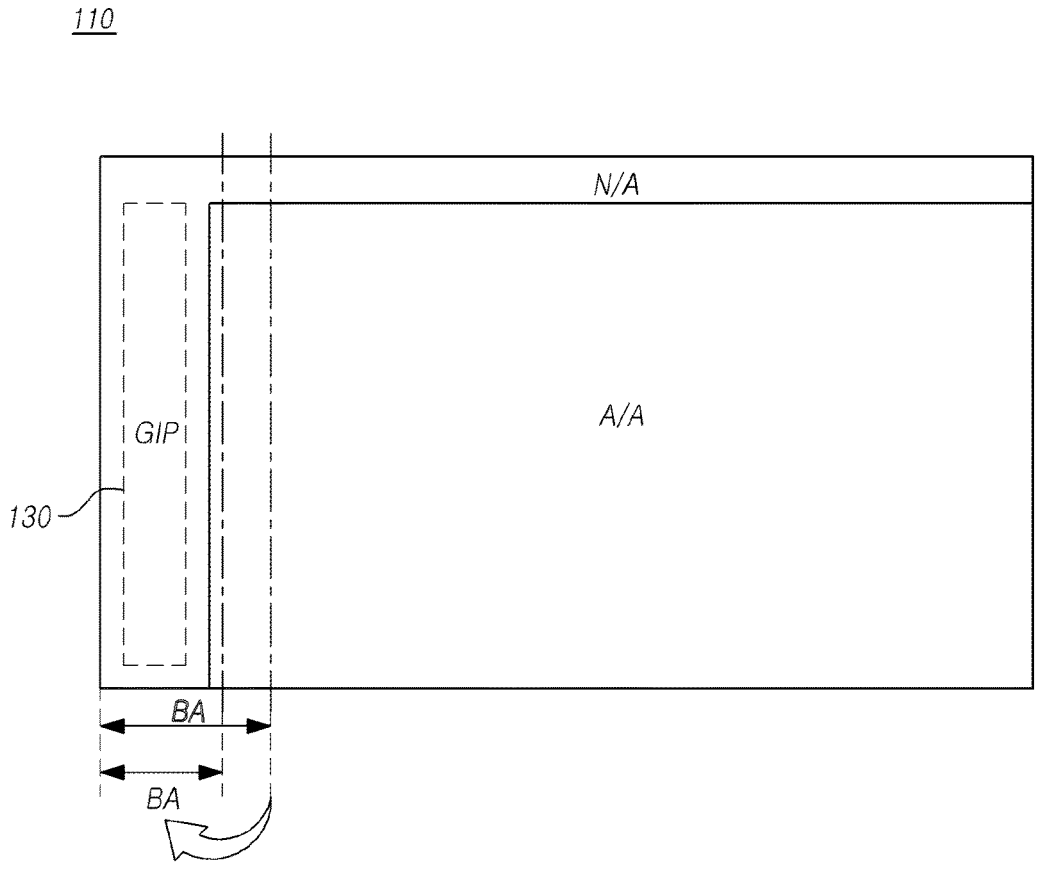
FIG. 9 is a diagram illustrating an example in which a bezel area decreases in an organic light-emitting display device with a GIP structure according to an embodiment of the present disclosure.

FIG. 9 is a diagram illustrating an example in which the bezel area decreases in the organic light-emitting display device with a GIP structure according to embodiments of the present disclosure.

Referring to FIG. 9, in the organic light-emitting display device according to embodiments of the present disclosure, since the internal compensation step using one scan signal for neighboring sub pixels in the column direction and the light-emitting step of displaying an image are performed, it is not necessary to provide an additional scan driver 130 (e.g., for providing the sensing signal SENSE).

Accordingly, it is possible to sense and compensate for degradation of the driving transistors using only the scan signals supplied to the gate lines GL disposed in the display panel 110 and thus to decrease the size of the scan driver 130.

It can be seen that the bezel area BA decreases from the width illustrated in FIG. 3B to the width illustrated in FIG. 9 with the decrease in the size of the scan driver 130.

In this way, in the organic light-emitting display device and the driving method thereof according to embodiments of the present disclosure, it is possible to decrease the size of the scan driver and the bezel area by simultaneously driving the first transistor T1 and the second transistor T2 disposed in neighboring sub pixels using the scan signal output from one scan driver.

In the organic light-emitting display device and the driving method thereof according to embodiments of the present disclosure, it is possible to drive a display while internally compensating for characteristics variations of sub pixels using one scan driver.

The above description and the accompanying drawings provide an example of the technical idea of the present disclosure for illustrative purposes only. Those skilled in the art will appreciate that various modifications and changes such as combinations, separations, substitutions, and changes of configurations are possible without departing from the essential features of the present disclosure. Therefore, the embodiments disclosed herein are intended to illustrate, not define, the technical idea of the present disclosure, and the scope of the present disclosure is not limited to the embodiments. The scope of the present disclosure shall be construed on the basis of the appended claims in such a manner that all the technical ideas within the range equivalent to the claims belong to the scope of the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An organic light-emitting display device, comprising:

a display panel in which data lines are arranged in a first direction and gate lines are arranged in a second direction to define a plurality of sub pixels;

a source driver configured to supply a data voltage to the data lines;

a scan driver configured to supply scan signals to the gate lines; and a timing controller configured to control a driving timing of the source driver and a driving of the scan driver, wherein the plurality of subpixels includes an (N−1)-th sub pixel and an N-th sub pixel that are adjacent to one another in a same column among the sub pixels, each of the (N−1)-th sub pixel and the N-th sub pixel including:

an organic light-emitting diode, a driving transistor configured to drive the organic light-emitting diode, a first transistor that is controlled by a sensing signal and that is coupled between a reference voltage line and a first node of the driving transistor, a second transistor that is controlled by a respective scan signal and that is coupled between a data line and a second node of the driving transistor, the second node being directly electrically connected to a gate of the driving transistor, and a storage capacitor that is connected between the first node and the second node of the driving transistor, and a gate node of the second transistor of the (N−1)-th sub pixel and a gate node of the first transistor of the N-th sub pixel are coupled in common such that the second transistor of the (N−1)-th sub pixel and the first transistor of the N-th sub pixel are simultaneously turned on by a scan signal supplied to the second transistor of the (N−1)-th sub pixel.

2. The organic light-emitting display device according to claim 1, wherein the sensing signal that controls the first transistor of the N-th sub pixel is the scan signal supplied to the (N−1)-th sub pixel.

3. The organic light-emitting display device according to claim 1, wherein the reference voltage line is coupled to the first transistors of each of the (N−1)-th sub pixel and the N-th sub pixel.

4. The organic light-emitting display device according to claim 1, wherein the second transistor of the (N−1)-th sub pixel and the second transistor of the N-th sub pixel are commonly connected to the same data line.

5. The organic light-emitting display device according to claim 1, wherein the first transistor is directly electrically connected between the reference voltage line and the first node of the driving transistor.

6. The organic light-emitting display device according to claim 1, wherein the storage capacitor is directly electrically connected between the first node and the gate of the driving transistor.

7. A driving method of an organic light-emitting display device including a plurality of sub pixels of which each includes an organic light-emitting diode, a driving transistor configured to drive the organic light-emitting diode, a first transistor that is controlled by a sensing signal and that is coupled between a reference voltage line and a first node of the driving transistor, a second transistor that is controlled by a scan signal and that is coupled between a data line and a second node of the driving transistor, and a storage capacitor that is coupled between the first node and the second node of the driving transistor, the driving method comprising:

performing initialization and data programming on an N-th sub pixel in an overlapping section of an N-th scan signal and an (N−1)-th scan signal, the N-th scan signal being a scan signal supplied to the N-th sub pixel, which has an N-th position in a column of the plurality of subpixels, and the (N−1)-th scan signal being a scan signal supplied to an (N−1)-th sub pixel having an (N−1)-th position in the column, the (N−1)-th sub pixel being adjacent to the N-th sub pixel in the column direction;

switching the (N−1)-th scan signal to a low level, causing the first node of the driving transistor of the N-th sub pixel to float, and compensating a threshold voltage of the driving transistor of the N-th sub pixel;

holding a voltage between the second node and the first node of the driving transistor of the N-th sub pixel by the compensation for the threshold voltage; and switching the N-th scan signal supplied to the second transistor of the N-th sub pixel to the low level and causing the organic light-emitting diode of the N-th sub pixel to emit light.

8. The driving method of an organic light-emitting display device according to claim 7, wherein the (N−1)-th scan signal supplied to the (N−1)-th sub pixel is the sensing signal that controls the first transistor of the N-th sub pixel.

9. The driving method of an organic light-emitting display device according to claim 7, wherein a period of the scan signal supplied to each sub pixel is greater than a period of supplied data voltages.

10. The driving method of an organic light-emitting display device according to claim 9, wherein the period of the scan signal supplied to each sub pixel is 3/2 of a horizontal period H and a period of the data voltage is one horizontal period H.

11. The driving method of an organic light-emitting display device according to claim 9, wherein the period of the scan signal supplied to each sub pixel has a constant high level in a first section corresponding to one horizontal period H, and has an inclined level in a second section corresponding to another horizontal period.

12. The driving method of claim 11, wherein the scan signal supplied to each subpixel linearly declines from the high level to the low level in the second section.

13. A display device, comprising:

a first subpixel in a first column of subpixels, the first subpixel including:

a first organic light-emitting diode coupled to a first node;

a first driving transistor coupled between a driving voltage line and the first node, the first driving transistor having a control terminal directly electrically connected to a second node;

a first sensing transistor coupled between a reference voltage line and the first node;

a first switching transistor coupled between a data voltage line and the second node, the first switching transistor having a control terminal coupled to a first scan line; and a first capacitor coupled between the first and second nodes; and a second subpixel in the first column of subpixels, the second subpixel being adjacent to the first subpixel in the first column, the second subpixel including:

a second organic light-emitting diode coupled to a third node;

a second driving transistor coupled between the driving voltage line and the third node, the second driving transistor having a control terminal coupled to a fourth node;

a second sensing transistor coupled between the reference voltage line and the third node, the second sensing transistor having a control terminal coupled to the first scan line;

a second switching transistor coupled between the data voltage line and the fourth node, the second switching transistor having a control terminal coupled to a second scan line; and a second capacitor coupled between the third and fourth nodes.

14. The display device of claim 13, further comprising:

a scan driver configured to supply respective scan signals to the first and second scan lines; and a source driver configured to supply a data voltage to the data voltage line.

15. The display device of claim 14, wherein the scan driver is configured to supply the first scan signal at a high level for a first period, and to supply the second scan signal at a high level for a second period that at least partially overlaps the first period.

16. The display device of claim 15, wherein the source driver is configured to supply a first data voltage to the data voltage line during at least a portion of the first period, and to supply a second data voltage to the data voltage line during at least a portion of the second period.

17. The display device of claim 14, wherein the scan driver is configured to:

supply the first scan signal at a high level during a first period;

supply the first scan signal at a level that linearly declines from the high level to a low level during a second period;

supply the second scan signal at a high level during the second period; and supply the second scan signal at a level that linearly declines from the high level to the low level during a third period.

18. The display device of claim 17, wherein the source driver is configured to:

supply a first data voltage to the data voltage line during the first period; and supply a second data voltage to the data voltage line during the second period.

19. The display device of claim 13, wherein the control terminal of the second driving transistor is directly electrically connected to the third node.

20. The display device of claim 13, wherein the first sensing transistor is directly electrically connected between the reference voltage line and the first node.

* * * * *